US011371310B2

(12) United States Patent
Quero et al.

(10) Patent No.: US 11,371,310 B2
(45) Date of Patent: Jun. 28, 2022

(54) ACTUATED INFLATABLE PACKER

(71) Applicant: HALLIBURTON ENERGY SERVICES, INC., Houston, TX (US)

(72) Inventors: Philippe Quero, Houston, TX (US); Bharat Bajirao Pawar, Duncan, OK (US); Desmond Wesley Jones, Duncan, OK (US); Harley Wayne Jones, II, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 381 days.

(21) Appl. No.: 16/639,515

(22) PCT Filed: Oct. 23, 2018

(86) PCT No.: PCT/US2018/056987

§ 371 (c)(1),
(2) Date: Feb. 14, 2020

(87) PCT Pub. No.: WO2019/083922

PCT Pub. Date: May 2, 2019

(65) Prior Publication Data

US 2021/0115751 A1 Apr. 22, 2021

Related U.S. Application Data

(60) Provisional application No. 62/576,978, filed on Oct. 25, 2017.

(51) Int. Cl.
*E21B 33/127* (2006.01)

(52) U.S. Cl.
CPC ..... *E21B 33/1277* (2013.01)

(58) Field of Classification Search
CPC ..... E21B 33/1277; E21B 33/12; E21B 33/127
See application file for complete search history.

(56) References Cited

U.S. PATENT DOCUMENTS 2,862,562 A * 12/1958 Hughes ..... E21B 33/127 166/151
5,236,047 A 8/1993 Pringle et al.
5,291,947 A * 3/1994 Stracke ..... E21B 34/066 166/187

(Continued)

FOREIGN PATENT DOCUMENTS

WO 2013172857 A1 11/2013

OTHER PUBLICATIONS

International Search Report and Written Opinion; PCT Application No. PCT/US2018/056987; dated Feb. 1, 2019.

*Primary Examiner* — Steven A MacDonald
(74) *Attorney, Agent, or Firm* — Polsinelli PC

(57) ABSTRACT

An inflatable packer assembly may include a housing and a shifting sleeve disposed within the housing. The shifting sleeve may have one or more sleeve ports formed therein. An actuator may be coupled with the shifting sleeve. The actuator may be electrically actuated between a plurality of positions. One or more inflatable packers may be coupled with the housing, the housing having one or more ports formed therein. Actuation of the actuator may shift the shifting sleeve in order for the one or more sleeve ports to enter into fluid communication with the one or more ports of the housing in order to inflate or deflate the inflatable packers.

20 Claims, 9 Drawing Sheets

(56) References Cited

U.S. PATENT DOCUMENTS

| | | | | |
|---|---|---|---|---|
| 6,742,598 | B2 | 6/2004 | Whitelaw et al. | |
| 7,604,062 | B2 | 10/2009 | Murray | |
| 8,286,703 | B2 | 10/2012 | Clapp et al. | |
| 9,739,127 | B2 | 8/2017 | Purkis et al. | |
| 10,641,052 | B2 * | 5/2020 | Zhou | E21B 33/12 |
| 2001/0015276 | A1 * | 8/2001 | Pringle | E21B 43/14 166/321 |
| 2011/0079390 | A1 | 4/2011 | Themig | |
| 2011/0174491 | A1 * | 7/2011 | Ravensbergen | A61K 48/0041 166/308.1 |
| 2014/0374119 | A1 | 12/2014 | Dewars et al. | |
| 2015/0027706 | A1 * | 1/2015 | Symms | E21B 33/146 166/185 |
| 2015/0075783 | A1 | 3/2015 | Angman et al. | |
| 2015/0330188 | A1 | 11/2015 | Moreno et al. | |
| 2016/0160603 | A1 | 6/2016 | Sevadjian et al. | |
| 2016/0265318 | A1 * | 9/2016 | Greci | E21B 43/08 |
| 2017/0218710 | A1 * | 8/2017 | Zhou | E21B 34/06 |
| 2018/0245428 | A1 | 8/2018 | Richards | |
| 2020/0217157 | A1 | 7/2020 | Oser et al. | |
| 2020/0248531 | A1 | 8/2020 | Walton et al. | |
| 2020/0263520 | A1 | 8/2020 | Frosell et al. | |
| 2021/0102443 | A1 | 4/2021 | Glaser | |

* cited by examiner

ACTUATED INFLATABLE PACKER

CROSS-REFERENCE TO RELATED APPLICATIONS

This application is a national stage entry of PCT/US2018/056987 filed Oct. 23, 2018, which claims the benefit of U.S. Provisional Application No. 62/576,978 filed Oct. 25, 2017, each of which is hereby incorporated by reference in its entirety.

FIELD

The present application is generally directed to packers used to selectively seal a wellbore, and more specifically to an electrically-actuated inflatable packer.

BACKGROUND

During various phases of the life of a wellbore, it may be necessary to isolate certain zones along the length of the wellbore. Packers may be employed to this end which can be placed in the annulus between tubing in the wellbore and the surface of the wellbore to prevent the flow of fluid. Two or more packers can be placed to isolate a zone along the length of the wellbore for various processes, including production or fracturing. There are various types of packers, which can be grouped according to type or function including mechanical set packers, inflatable packers, and hydraulic packers, amongst others.

BRIEF DESCRIPTION OF THE DRAWINGS

Embodiments of the present application are described, by way of example only, with reference to the attached Figures, wherein.

DETAILED DESCRIPTION

Figure 1:
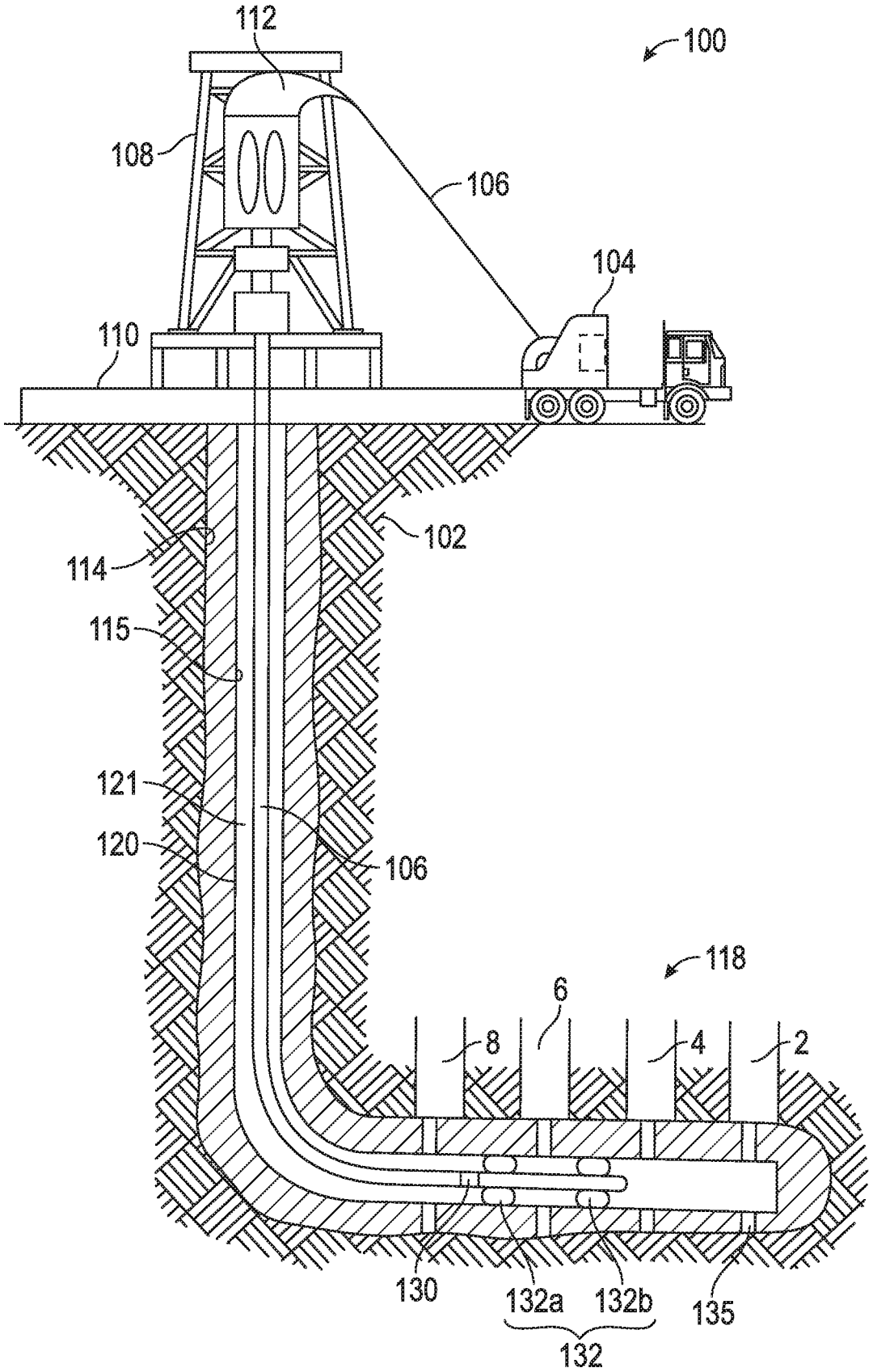
FIG. 1 is a schematic view of a wellbore operating environment in which an electrically actuated inflatable packer may be deployed, according to various embodiments of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed compositions and methods may be implemented using any number of techniques. The disclosure should in no way be limited to the illustrative implementations, drawings, and techniques illustrated herein, but may be modified within the scope of the appended claims along with their full scope of equivalents.

The present disclosure provides an electrically actuated inflatable packer assembly, which in at least one aspect may be capable of achieving real-time, on demand control of the inflatable packer on a coiled tubing string (or other tubular conveyance). The electrically actuated inflatable packer assembly can be coupled with a downhole tool string, including in at least one instance a bottom hole assembly. The electrically actuated inflatable packer assembly can include a housing, an electric actuator, a shifting (or sliding) sleeve, and one or more inflatable packers. The shifting sleeve can have one or more ports formed therein. The housing can include at least one treatment port formed therein providing fluid communication to one or more inflatable packers. Additionally, the one or more inflatable packers can have one or more flow ports formed therein. The electric actuator can shift the sliding sleeve between a plurality of configurations (positions, in any order) to place the one or more flow ports in fluid communication with the one or more housing ports formed in one of the packers' housing. In some examples a packer disclosed herein may include one or one or more inflation and one or more deflation ports. During inflation, the shifting sleeve or rod can establish fluid communication with the one or more inflation ports. During deflation, the shifting sleeve or rod can establish fluid communication with the one or more deflation ports. The inflation ports and deflation ports may be the same.

In some instances, the fluid communication can be established by placing ports in alignment with one another. In many instances this alignment may be in the form of an overlap between the ports, where the outer perimeter of each respective port mutually intersects the other to form an overlapping area between the ports. Fluid communication is then established between the respective ports at this overlapping area. When the ports are immediately one on top of the other, little to no fluid is able to escape and is instead passed between the ports through this overlapping area. Furthermore, the ports may often have depth, therefore, in such cases, it is the mouths of each of the respective ports which have this overlap. In other instances, alignment may be present where the respective ports do not overlap with one another, but instead each overlap with a fluid channel passing between the ports. This also establishes fluid communication between and through each of the respective ports.

An aspect of this disclosure includes an inflatable packer assembly electrically operated, which can be reliably inflated or deflated on demand. Specifically, packer assemblies can be deployed on electric or hybrid cable-enabled tubular conveyance, such as a Coiled Tubing (CT). Common pumping fluid (e.g., water, clean water, etc.) can be used to inflate and/or deflate the one or more inflatable packers in real-time by, for example, using CT hydraulics and the like. As a result, closed circuit hydraulics can be avoided from having to be included in, for example, the bottom hole assembly. Furthermore, packer configuration (e.g., inflated, deflated, etc.) can be selected without requiring pipe (e.g., CT) movement (e.g., jar sequence) inside and/or outside of the borehole. Packer configuration may additionally be selected without pumping or pressurizing fluids or requiring particular sequences of the same. The packers can be utilized for selective injection and/or selective stimulation in a wellbore.

In another aspect, a bottom hole assembly (BHA) is disclosed which can be attached below existing tools. An electric motor can be positioned below the BHA. In some examples, the electric motor may be positioned concentric to the BHA. An electrically-driven motor actuates a shifting sleeve or rod, which can be connected below the electric motor. At different linear positions of the shifting sleeve or rod, housing ports may align with inflation ports, deflation ports, and/or treatment ports.

In some examples, flow from inside the CT may exit into an annulus between the electric motor and the housing before flowing back into the sleeve (e.g., into an internal diameter (ID) or channel of the sleeve). At a predetermined depth in the wellbore, the sleeve can shift into an inflate configuration in order to allow pumping fluid to flow into the packers. As a result, the inflowing fluid may inflate the packers. Upon further shifting of the sleeve, pressure inside the packers can be locked and a treatment port can be aligned with a housing port. In this configuration, selective stimulation of the wellbore can be performed via the treatment port and the inflated packer.

FIG. 1 illustrates a schematic view of an embodiment of a wellbore operating environment in which an electrically actuated inflatable packer assembly may be deployed. As depicted in FIG. 1, the operating environment 100 includes a wellbore 114 that penetrates a subterranean formation 102 that includes a plurality of formation zones 2, 4, 6, and 8 for the purpose of recovering hydrocarbons, storing hydrocarbons, disposing of carbon dioxide, or the like. The wellbore 114 may extend substantially vertically away from the Earth's surface over a vertical wellbore portion, or may deviate at any angle from the Earth's surface over a deviated or horizontal wellbore portion 118. In alternative operating environments, portions or substantially all of the wellbore 114 may be vertical, deviated, horizontal, and/or curved. The wellbore 114 may be drilled into the subterranean formation 102 using any suitable drilling technique. A casing 115 is secured into position against the formation 102 in a conventional manner with cement.

As illustrated, a servicing rig disposed at the surface includes a derrick 108 with a rig floor 110 through which a wellbore tubular 106 (e.g., a drill string, a tool string, a segmented tubing string, a jointed tubing string, or any other suitable conveyance, or combinations thereof) generally defining a flowbore may be positioned within or partially within the wellbore 114. The wellbore tubular 106 may be drawn from a wellbore servicing unit 104 to the derrick 108 via gooseneck 112. The wellbore tubular 106 extends within the wellbore 114 forming an annulus 121 between the external surface of the wellbore tubular 106 and the walls of the casing 115 (or walls of the wellbore 114 when uncased). In some embodiments, the wellbore tubular 106 may include two or more concentrically positioned strings of pipe or tubing (e.g., a first work string may be positioned within a second work string). In such an environment, the wellbore tubular 106 may be utilized in stimulating, completing, producing or otherwise servicing the wellbore, or combinations thereof.

While FIG. 1 depicts a stationary drilling rig, one of ordinary skill in the art will readily appreciate that mobile workover rigs and the like may be employed. It is noted that while one or more FIGs. herein may exemplify horizontal or vertical wellbores, the principles of the presently disclosed apparatuses, methods, and systems, may be similarly applicable to horizontal wellbore configurations, conventional vertical wellbore configurations, deviated wellbore configurations, and any combinations thereof. Therefore, the horizontal, deviated, or vertical nature of any figure is not to be construed as limiting the wellbore to any particular configuration.

As illustrated in FIG. 1 an electrically actuated inflatable packer assembly 132 having an uphole inflatable packer 132*a* and downhole inflatable packer 132*b*, may be disposed along wellbore 120. In some instances, the electrically actuated inflatable packer assembly 132 may be used to isolate two or more adjacent portions or zones 2, 4, 6, 8 of subterranean formation 102 and/or sections of wellbore 120. While one inflatable packer assembly is illustrated, any plurality of such inflatable packer assemblies may be employed having one, two or more packers. As depicted in FIG. 1, the electrically actuated inflatable packer assembly 132 includes a downhole electric system 130 for actuating of the electrically actuated inflatable packer assembly 132 and inflation and deflation of uphole and downhole inflatable packers 132*a*, 132*b*, or other operations such as ejection of treatment fluid. The wellbore tubular 106 may include wiring or other conductors for communication and/or power with the electrically actuated inflatable packer assembly 132 and/or downhole electric system 130. The electrically actuated inflatable packer assembly 132 can be used in well intervention services such as, but not limited to, selective stimulation, fracturing, chemical shut off, plug and abandon (P&A) and the like. For example, perforations 135 can be isolated for specialized treatment and the like.

Figure 2:
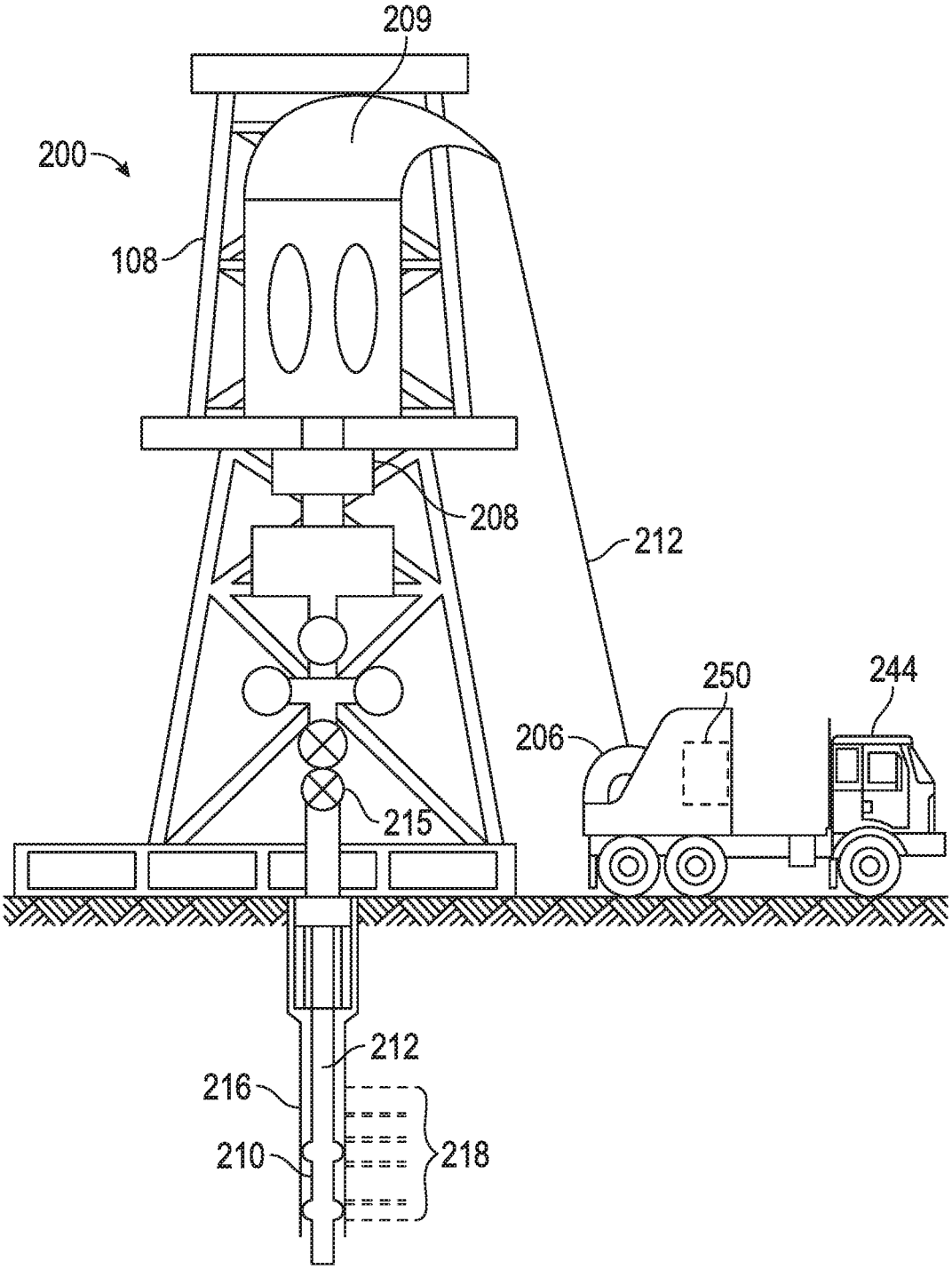
FIG. 2 is a schematic diagram of an example conveyance environment, according to various embodiments of the subject technology.

FIG. 2 illustrates a diagrammatic view of a wellbore operating environment 200 in which the present disclosure can be implemented. Tubular conveyance 212 may be drawn from reel 206 over gooseneck 209 and inserted into wellbore 216. The tubular conveyance 212 may be CT, pipe, or other tubular, and includes wires (one or more wires), cables, or the like. Wellbore 216 extends through various zones 218 which, in some examples, may be isolated for treatment, etc. Derrick 108 may include a tubing injector 208 in order to raise or lower the tubular conveyance 212 having subsections (subs) with a tool 210 into or out of the a wellbore 216. A fluid passageway 215 may provide for fluid entry into the tubular conveyance 212 (e.g., in order to provide treatment fluid and the like). The tool 210 or the tubular conveyance 212 may include the electrically actuated inflatable packer assembly disclosed herein. Power can be supplied via the tubular conveyance 212 to meet power requirements of the tool. Tool 210 may have a local power supply, such as batteries, downhole generator and the like. When employing non-conductive cable and coiled tubing, communication may be supported using, for example, wireless protocols (e.g., EM, acoustic, etc.), and/or measurements and logging data can be stored in local memory for subsequent retrieval. Processing unit house 244 may include a computing device 250 able to communicate with the devices and systems of the present disclosure.

Figure 3:
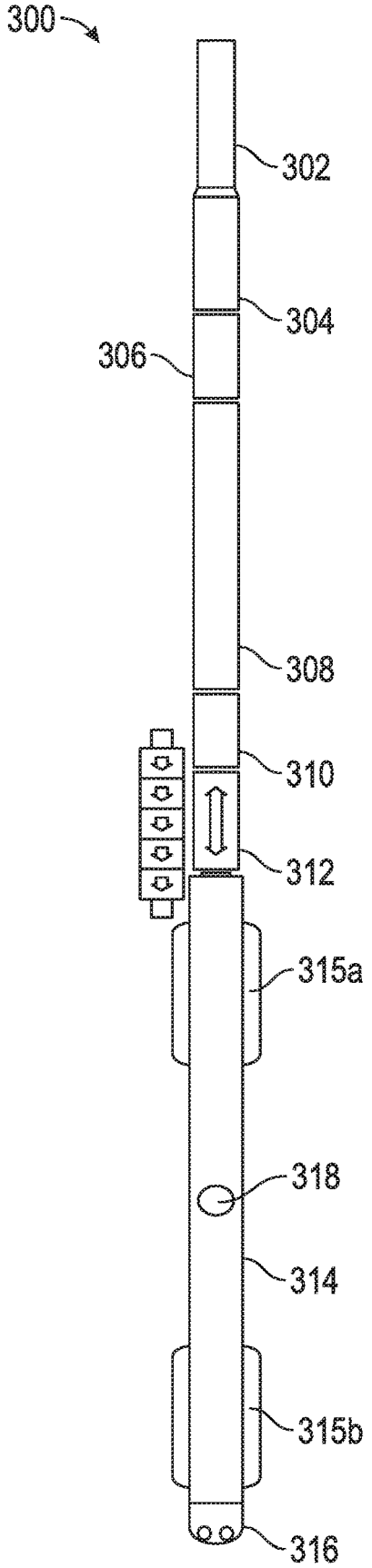
FIG. 3 is a diagrammatic view of an electrically actuated inflatable packer system and related downhole tool string according to the present disclosure.

FIG. 3 schematic diagram of a tool string in the form of a packer bottom hole assembly (BHA) 300 including an electrical actuated packer extending from a conveyance 302, which may be an electric or hybrid cable-enabled CT or other tubular. The packer BHA 300 can be manipulated by, for example, a surface controller transmitting signals along a wired and/or wireless transmission system. In some examples, the electrically actuated inflatable packers may report state data back to the controller and the like via wired or wireless transmission.

The packer BHA 300 includes an upper inflatable packer element 315*a* and a lower inflatable packer element 315*b*, as part of a packer assembly 314, as well as an electric jack 312. The upper and lower packer elements 315*a*, 315*b* may be, for example, an elastomer or other expandable component. A bullnose 316 is disposed below the packer assembly 314 on its downhole end. Electric jack 312 can manipulate a sliding sleeve (shown in FIGS. 5-7 below) which may be contained within the packer assembly 314. The sliding sleeve may be shifted to place one or more of its ports (inflate ports, deflate ports, treatment ports, and the like) in fluid communication (e.g., by alignment) with ports in the housing which provide fluid communication to the upper packer element 315*a* (and/or lower packer element 315*b*) or to the annulus. For example, the packer assembly 314 has a housing treatment port 318 which may be placed in fluid communication with the treatment port of the sliding sleeve contained within the packer assembly 314 to eject treatment into the wellbore and surrounding formation. In other examples, the sliding sleeve's other ports may be used to inflate or deflate the upper and/or lower packer elements 315*a*, 315*b*. For example, when in an inflated configuration (discussed below), upper and lower inflatable packers 315*a* and 315*b* can isolate sections of a borehole to allow for targeted treatments via housing treatment port 318 and the like.

Electric jack 312 may serve as an electric actuator, and in particular may be an electric motor. The electric jack 312 may be disposed uphole from and coupled with the packer assembly 314 thereby forming an electrically actuated packer assembly within the packer BHA 300. Electric jack 312 can be powered over wire by, for example, direct and/or indirect connection to a conveyance 302 which may include a hybrid cable. The hybrid cable of conveyance 302 may facilitate both data and power transmission along the packer BHA 300. In some examples, electric jack 312 can include a battery power and the like. While, the electric jack 312 is a part of the overall packer BHA 300, alternatively it may also be considered as a separate tool along a work string.

Electric jack 312 may be coupled to an electric crossover 310 in order to direct fluid flow around electric jack 312 and convey electrical power for articulation of the sliding sleeve. Coupled electrically activated jack 312 and electric crossover 310 may enable real-time and on-demand control of the packer BHA 300 by providing space in which to, and electrically powered force for, adjusting the shifting sleeve, which may be a sleeve or rod. In some examples, the shifting sleeve may instead or additionally include a tubular or a substantially circumferential wall and the like.

Various other components and modules of the packer BHA 300 may be located either uphole or downhole from the inflatable packer 314. For example, a sensor module 308 can be disposed uphole from the packer assembly 314, as well as the electric jack 312, and electric crossover 310. Sensor module 308 can provide, in a bottom hole assembly (BHA) for example, real-time information regarding packer inflation by utilizing a differential pressure measurement with a graph of pre-calibrated pressure versus inflation via external and/or internal pressure sensors and the like.

Furthermore, in at least one example, a motor head 306 and/or a cable head 304 may be located linearly along the conveyance 302 and/or electrically actuated inflatable packer assembly either uphole or downhole from the packer assembly 314. Various other tools and modules can be similarly located along conveyance 302 and nearby packer BHA 300.

Fluid may flow from an internal channel, or the shifting sleeve, of a downhole tool into an annulus between electric jack 312 and an outer housing before flowing back inside the internal channel (e.g., the ID) of the shifting sleeve. In some examples, with the shifting sleeve in an inflate configuration and at a predetermined depth in a wellbore, fluid pumped downhole inflates the packer elements 315*a*, 315*b* of packer assembly 314.

In at least one example, upper and lower inflatable packer elements 315*a* and 315*b* can be complemented by additional electrically actuated inflatable packer elements (not depicted). The upper and lower inflatable packer elements 315*a* and 315*b* may be electrically actuated to isolate a zone for treatment. The upper inflatable packer element 315*a* may, for example, be uphole from a desired treating portion of a formation within the wellbore and the lower inflatable packer element 315*b* may be downhole from the desired treating portion of the formation. Upon further activation of sleeve, pressure inside the packer is locked and a treatment port is aligned. At this stage selective stimulation can be performed.

Figure 4:
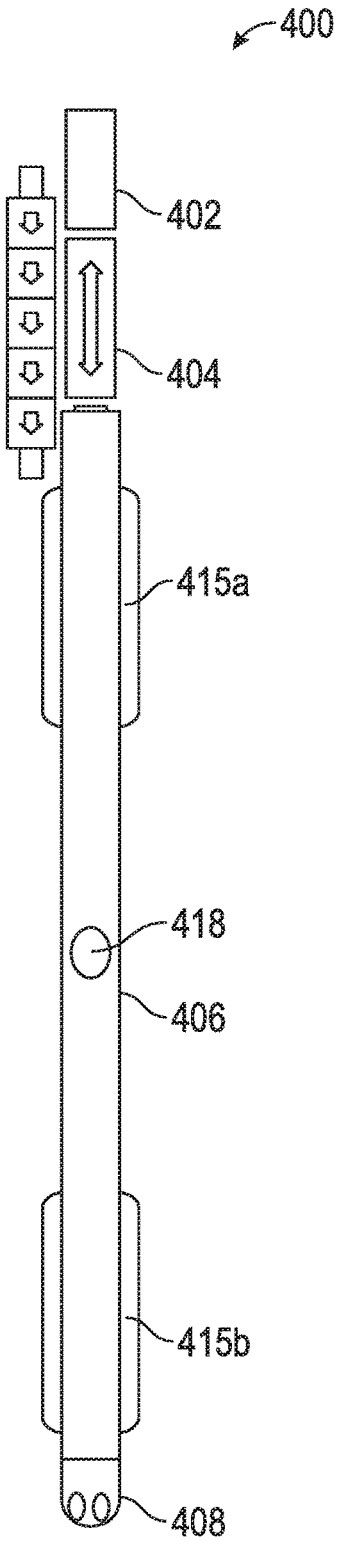
FIG. 4 is a diagrammatic view of an electrically actuated inflatable packer system according to the present disclosure.

FIG. 4 is a schematic diagram of a tool string in the form of an electrically actuated packer assembly 400, which may be used alternatively to, or in addition to, the packer BHA 300. In particular, the electrically actuated packer assembly 400 includes no additional sensor components. Electrically actuated inflatable packer assembly 400 includes an electric crossover 402 and an electric jack 404 coupled to a packer assembly 406, which includes upper inflatable packer element 415*a* and lower inflatable packer element 415*b*. As with packer BHA 300, electrically actuated inflatable packer assembly 400 may further include a bull nose nozzle 408. In particular, electric crossover 402 can integrate into the electrically actuated inflatable packer assembly 400 without a cable head such as in the case, for example, where an internal power supply and/or wireless controls are employed. Similarly to the packer BHA 300, the electrically actuated inflatable packer assembly 400 further includes a treatment port 418 for performing wellbore treatments and the like (further discussed below).

Figure 5:
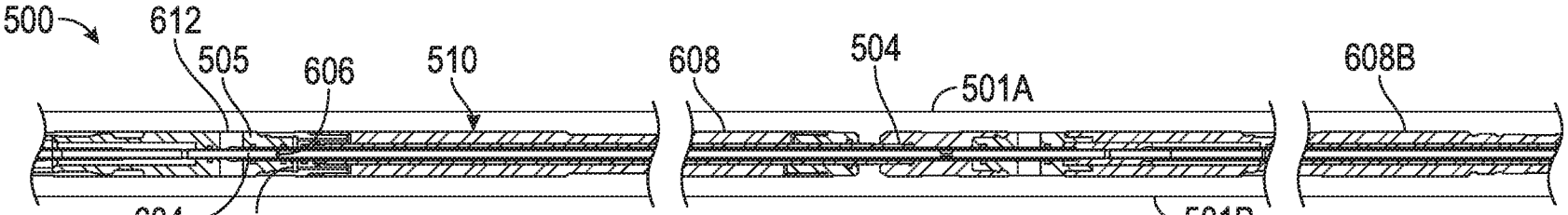
FIG. 5 is a cross-section view of an electrically actuated inflatable packer in a fully retracted configuration according to the present disclosure.
Figure 6A:
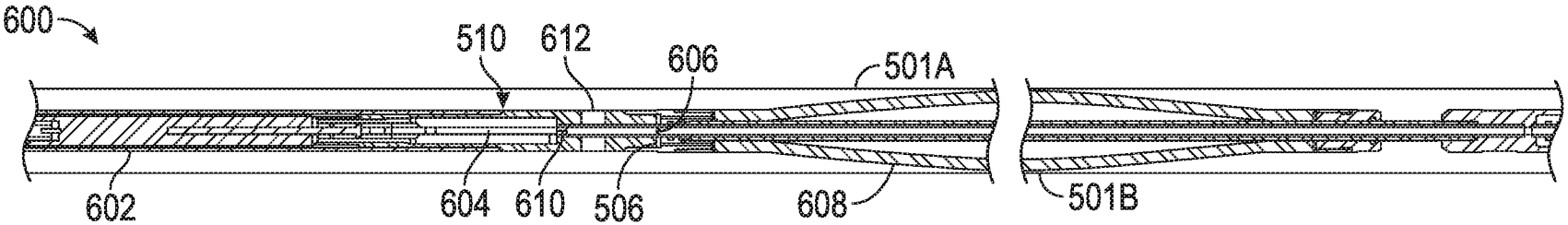
FIG. 6 is a cross-section view of an electrically actuated inflatable packer in an inflated configuration according to the present disclosure.
Figure 6B:
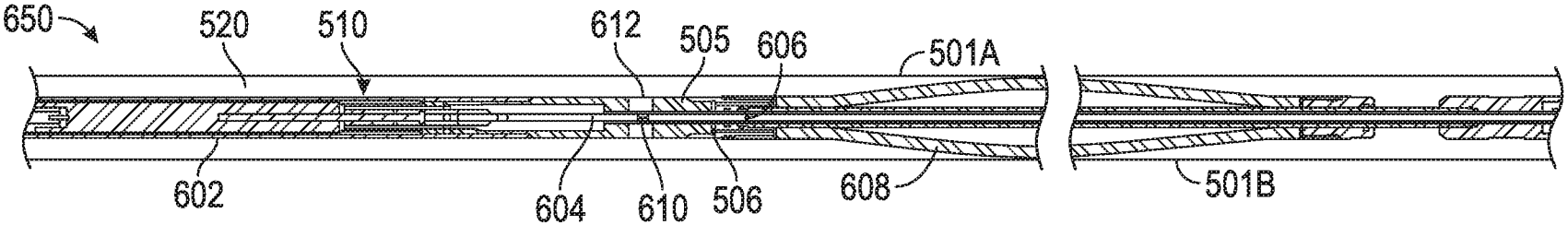
Figure 7:
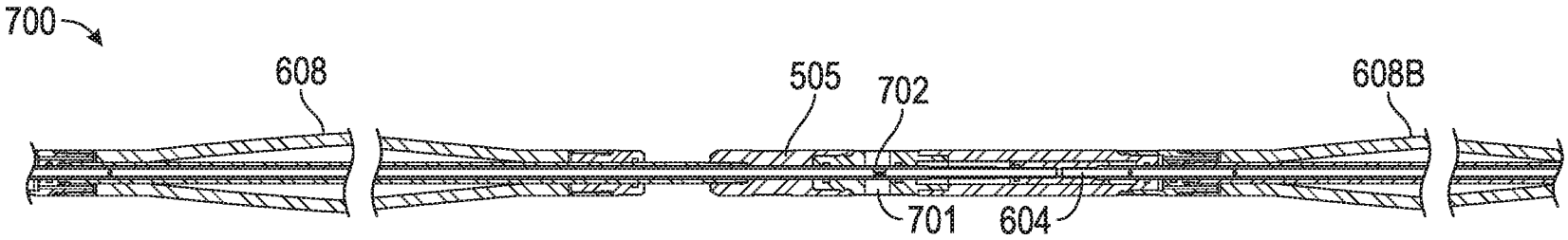
FIG. 7 is a cross-section view of an electrically actuated inflatable packer in a treatment configuration according to the present disclosure.

FIGS. 5-9B illustrate an electrically actuated inflatable packer assembly in various stages of deployment. In particular, FIG. 5 depicts an electrically actuated inflatable packer assembly 510 in a retracted configuration 500, while FIG. 6A depicts the same in an inflate configuration 600, FIG. 6B in a circulation/equalization configuration 650, while FIG. 7 depicts the electrically actuated inflatable packer assembly 510 in a treatment deployment configuration 700. Each of these is discussed in detail in the following.

FIG. 5 is a cross-section view depicting the shifting sleeve 604 in a retracted configuration, thereby also placing the electrically actuated inflatable packer assembly 510 in a retracted configuration 500. The shifting sleeve 604 can be fully retracted by placing an actuator (such as electric actuator 602 in FIG. 6A below) into an unactuated, or zero, position. The shifting sleeve 604 may be implemented as a sub, and may be tubular, or a rod, and is operable to slide along a flowbore or fluid channel within housing 505 in order to direct fluid within the flowbore or fluid channel. The shifting sleeve 604 may have one or more shifting sleeve ports, such as inflation port 606. Such shifting sleeve ports may be initially positioned out of fluid communication with ports in the housing (also referred to herein as housing ports). For instance, inflation port 606 of shifting sleeve 604 is shown as not in fluid communication, and unaligned, with the housing packer port 506 located within housing 505. The housing packer port 506 is in fluid communication with inflatable packer 608 providing a fluid channel thereto.

When aligned, fluid may pass from within the shifting sleeve 604 and/or the fluid channel of the housing 505 to the inflatable packer 608. For example, one aligned position may include inflation port 606 in fluid communication with housing packer port 506 via direct overlap of respective apertures of the ports (shown in FIG. 6B below). In the fully retracted configuration, fluid is unable to enter housing packer port 506 and so the inflatable packer 608 maintains a deflated state (e.g., flat against the body of inner tubing 504) and not in contact with surrounding walls 501A-B, which may be the surface of a casing lining a wellbore, or the surface of the wellbore. While walls 501A-B are depicted here as opposed walls, it is understood that walls 501A-B may be a continuous, substantially circular wall such as in a tubing and/or wellbore environment. Similarly, a second lower inflatable packer 608B may be deflated when shifting sleeve 604 is retracted and inflated when shifting sleeve 604 is shifted to provide fluid communication to inflate inflatable packer 608B, or by a duplicate shifting sleeve nearer to inflatable packer 608B.

In some examples, retracted configuration 500 is also a circulate/circulating configuration. That is to say, with inflatable packer 608 deflated, fluid may circulate throughout drilling string or inner tubing 504 and/or a surrounding wellbore environment. As a result, obstructive material and the like can be circulated out of the wellbore environment during the intervention process. Further shown in FIG. 5 is equalization port 610 on the shifting sleeve 604 and a housing equalization port 612, which are further described in circulation/equalization configuration 650 of FIG. 6 B.

Now turning to FIG. 6A, shown therein is a cross-section view showing the shifting sleeve 604 having been shifted into an inflate configuration, thereby also placing the electrically actuated inflatable packer assembly 510 into inflate configuration 600. In inflate configuration 600, inflatable packers 608 can expand as, for example, a fluid and the like is able to enter into inflatable packers 608 from inflation port 606 of the shifting sleeve 604 through housing packer port 506 in the housing 505. Further, in inflate configuration 600, inflatable packers 608 abut walls 501A-B of the wellbore thereby forming a seal (e.g., to isolate a particular section of a downhole environment).

As illustrated, electric actuator (or jack) 602 can slide shifting sleeve 604 downhole and into inflate configuration 600 from retracted configuration 500. In inflate configuration 600, an inflation port 606 on shifting sleeve 604 is placed in fluid communication, by alignment of the corresponding ports, with housing packer port 506 on housing 505 to allow inflation of inflatable packer 608. In at least one example, inflation occurs by circulating wellbore fluid through shifting sleeve 604 and into packers 608 via one or more channels created by the alignment of ports 506, 606.

Any wellbore fluid, such as, for example and without imputing limitation, water or a portion of pre-staged fluid within the wellbore column, or pumped from the surface, and the like can be circulated through inflation port 606 and into packers 608 for inflation. In at least one instance, inflate configuration 600 aligns at least one inflation port 606 for an uphole packer 608 and another inflation port 606 for a downhole packer 608B (shown in FIG. 5), thus allowing a portion of the wellbore to be isolated between two packers.

It should be understood that the present disclosure can be implemented with a single inflatable packer, or two, three, four, five, or any number of inflatable packers. Furthermore, electrically actuated inflatable packer 608 can have one or more inflation configurations to provide individual packer inflation depending on the provided arrangement. For example, an upper inflatable packer may be inflated while an inflatable packer immediately below may be deflated as inflation ports corresponding to the inflatable packer immediately below may be remain in an unaligned position while the upper inflatable packer inflation ports are aligned with housing ports and the like.

FIG. 6B is a cross-section view showing electric actuator 602 sliding shifting sleeve 604 into a circulation/equalization configuration, thereby placing electrically actuated inflatable packer assembly in circulation/equalization configuration 650. An equalization port 610 on the shifting sleeve 604 is placed in fluid communication with a housing equalization port 612 in housing 505 by aligning he corresponding ports, in order to allow fluid to circulate into the annulus 520 while inflatable packer 608 is maintained at a selected pressurization. In circulation/equalization configuration 650, inflatable packer 608 continues to abut surrounding walls 501A-B as the selected pressurization is maintained (e.g., to maintain a continued isolation of a downhole environment or the like).

FIG. 7 is a cross-section view showing shifting sleeve 604 shifted to a treatment configuration, thereby placing electrically actuated inflatable packer assembly in circulation/equalization configuration 700. A housing treatment port 701 is located in housing 505 between uphole packer 608 and a downhole packer 608B. In treatment configuration 700, treatment port 702 on shifting sleeve 604 is placed in fluid communication with housing treatment port 701 on housing 505, by aligning the corresponding ports. Treatment port 702 is exposed to a surrounding subterranean formation (e.g., the borehole environment) via fluid communication through the aligned ports 701, 702. As a result, wellbore fluid can circulate from shifting sleeve 604 and out through housing treatment port 701 in order to treat the formation (e.g., formation 102 in FIG. 1, etc.). For example, and without imputing limitation, the wellbore fluid may be an acidizing treatment fluid, diverting treatment fluid, fracturing fluid, and/or any other treatment fluid for use in a subterranean wellbore.

While circulation/equalization configuration 700 depicts shifting sleeve 604 extending between uphole packer 608 and downhole packer 608B, it is understood that shifting sleeve 604 can alternatively stop above, for example, uphole packer 608 in order to allow circulation operations above a specified zone of a subterranean wellbore. Likewise, shifting sleeve 604 may, in some examples, be entirely below a downhole packer (e.g., downhole packer 608B) in order to allow circulation operations below a specified zone of a subterranean wellbore. Additionally, circulation through the shifting sleeve 604 can include a ball or other obstruction dropped from within the shifting sleeve 604 or otherwise activated from within the housing 505 in order to prevent fluid circulating through elements beneath the shifting sleeve 604 and the like.

Figure 8:
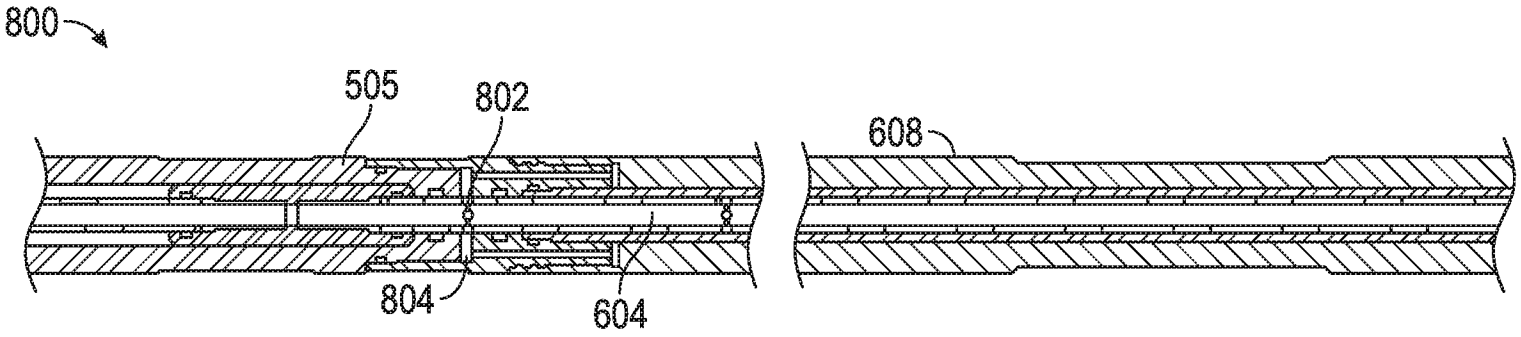
FIG. 8 is a cross-section view of an inflate port section of an electrically actuated inflatable packer according to the present disclosure.

FIG. 8 is a cross-section view showing shifting sleeve 604 shifted downhole into a deflate configuration thereby placing electrically actuated inflatable packer assembly in deflate configuration 800. In deflate configuration 800, a deflate port 802 on shifting sleeve 604 is placed in fluid communication with a packer deflation port 804 (which may be the same port as housing packer port 506) on housing 505 by aligning the corresponding ports. As the packer deflation port 804 is in fluid communication with the internal portion of inflatable packer 608 (by providing a fluid channel) it allows fluid to flow out of inflatable packer 608. As a result, fluid pressure within inflatable packer 608 decreases and so inflatable packer 608 deflates. Deflate configuration 800 can provide for deflation of any number of inflatable packers either individually or in a group by arranging alignment of packer deflation ports on the housing 505 (or another housing) with deflation ports on the shifting sleeve 604 (or another duplicate shifting sleeve).

Figure 9A:
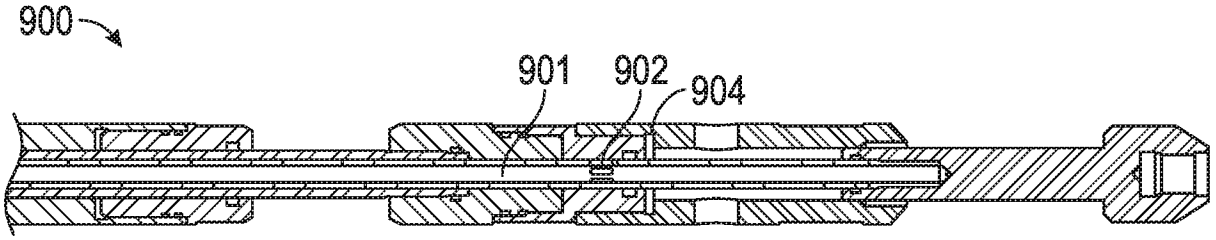
FIG. 9A is a cross-section view of an electrically actuated inflatable packer with ports closed to an annulus according to the present disclosure.
Figure 9B:
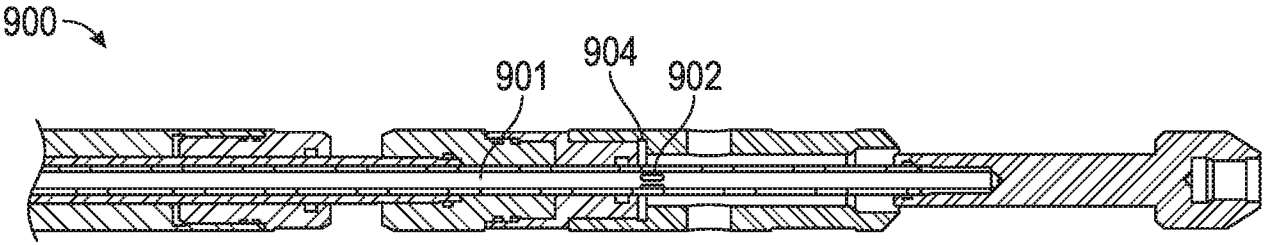
FIG. 9B is a cross-section view of an electrically actuated inflatable packer with ports open to an annulus according the present disclosure.

FIGS. 9A and 9B are cross-section views showing a sequence of a shifting sleeve 901, which may be the same or different from shifting sleeve 604, moving from a treatment position (e.g., treatment configuration 700) to a retracted or deflate configuration (e.g., retracted configuration 500, or deflate configuration 800). In particular, a downhole portion 900 of a drill string is shown.

FIG. 9A is a cross-section view depicting deflation port 902 as unaligned with a housing drain port 904. As a result, fluid is unable to drain from the drill string and into, for example, an annulus of a surrounding wellbore or the like. However, FIG. 9B depicts the shifting sleeve 901 sliding downhole and deflation port 902 and housing drain port 904 placed into fluid communication. As a result, a channel is formed by the aligned ports through which fluid can flow into the wellbore annulus.

Figure 10:
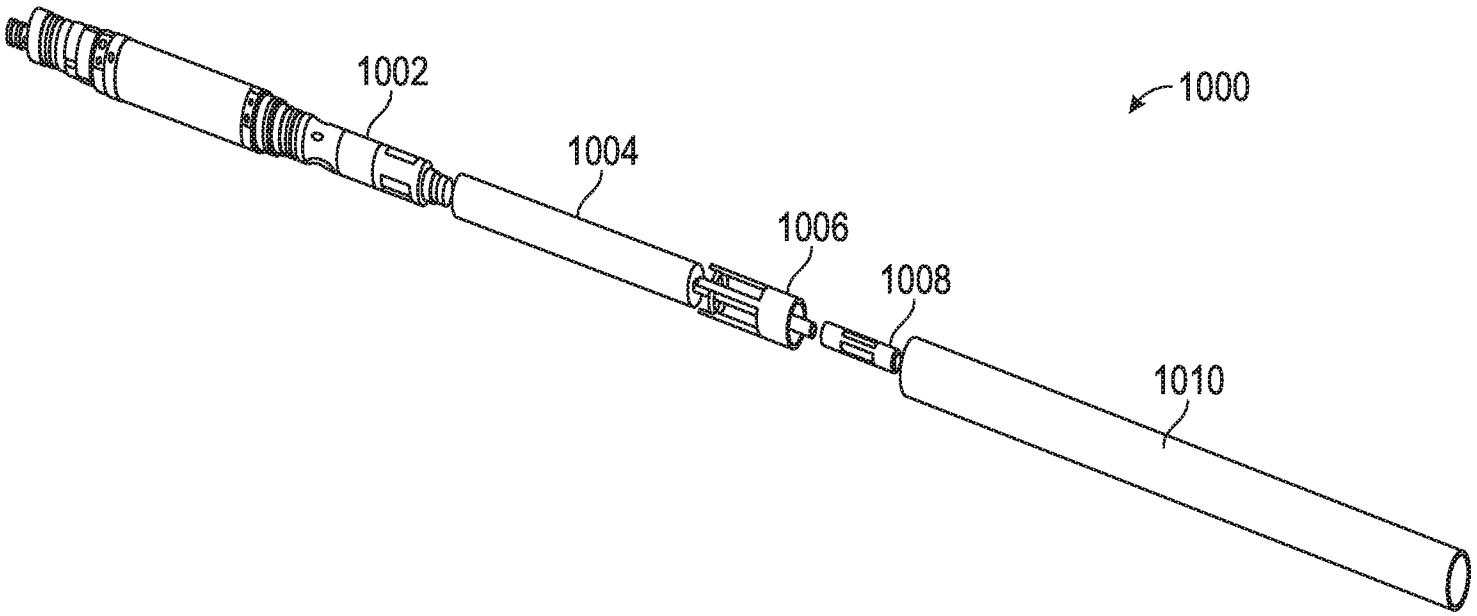
FIG. 10 is an isometric view of an electric crossover jack assembly according to the present disclosure.

FIG. 10 is a cross-section view depicting an example jack assembly 1000. An electric crossover sub 1002 is connected to a jack 1004. A centralizer 1006 is disposed over jack 1004 in order to keep jack 1004 concentrically aligned with a jack housing 1010. A jack shaft coupling 1008 is disposed downstring from jack 1004 and at an opposite end of jack 1004 from electric crossover sub 1002.

When assembled, jack housing 1010 substantially sheathes connected electric crossover sub 1002, jack 1004, centralizer 1006 and jack shaft coupling 1008. Other tools (or other components of the electrically actuated inflatable packer assembly) may be disposed downstring of jack assembly 1000 and coupled to jack assembly 1000 via jack shaft coupling 1008.

Figure 11:
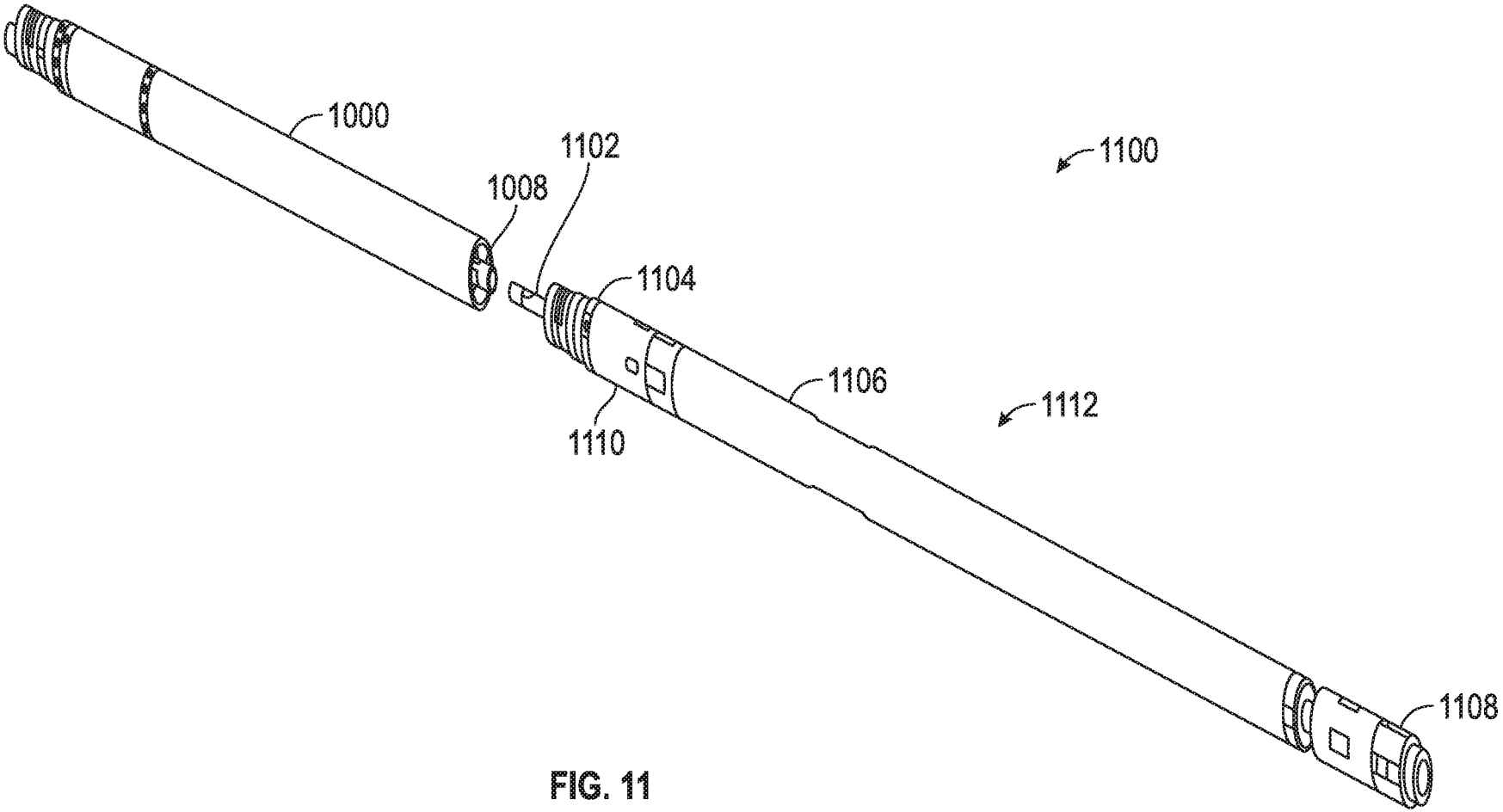
FIG. 11 is an isometric view of an electric crossover jack and inflatable packer top element assembly according to the present disclosure.

FIG. 11 shows electric jack assembly 1000 connected to packer assembly 1112 having packer 1106 to form an electrically actuated inflatable packer assembly 1100. Jack assembly 1000 is connected to a packer assembly 1112 via coupling of jack shaft coupling 1008 and a sliding mandrel 1102.

Sliding mandrel 1102 is partially disposed within and connectively joined to electrically actuated inflatable packer assembly 1112. A split ring 1104 provides a seal between jack assembly 1000 and electrically actuated inflatable packer assembly 1112 when fully assembled. A ported sub 1110, disposed directly below split ring 1104, can include housing ports which sliding mandrel 1102, when connected to jack assembly 1000 via jack shaft coupling 1008, can shift to align with, for example, treatment ports, deflation ports, inflation ports, and the like as discussed above.

As a result, the electrically actuated inflatable packer assembly 1100 can be cycled through, for example, the configurations discussed above (e.g., inflate, deflation, treatment, equalize, etc.). Further, a ported inter-element sub 1108 may provide for another downstring inflatable packer, which may similarly be cycled through various configurations as housing ports on ported inter-element sub 1108 are aligned and/or unaligned with the other downstring inflatable packer (not depicted).

Figure 12:
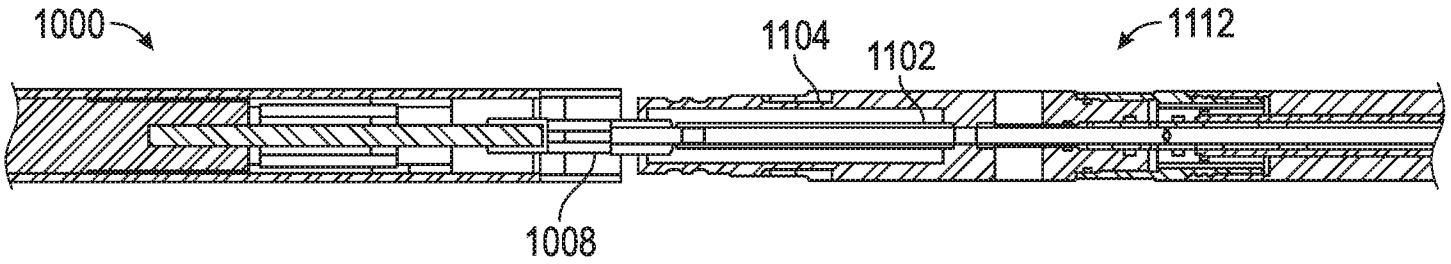
FIG. 12 is a schematic view of the electric crossover jack assembly and packer assembly of FIG. 11.

FIG. 12 shows a schematic view of the coupled electric jack assembly 1000 and packer assembly 1112 of FIG. 11. In particular, jack shaft coupling 1008 is coupled to sliding mandrel 1102, which extends substantially into packer assembly 1112. As a result, packer assembly 1112 and jack assembly 1000 are operatively engaged. Split ring 1104 can also be seen.

Numerous examples are provided herein to enhance understanding of the present disclosure. A specific set of statements are provided as follows.

Statement 1: An electrically actuated inflatable packer is disclosed as comprising: a housing coupled with a tubular conveyance, the housing having a housing port formed therein; a shifting sleeve disposed within the housing, the shifting sleeve having one or more sleeve ports formed therein; an inflatable packer coupled with the housing, and in fluid communication with the housing port; and an electric actuator operable to shift the shifting sleeve between an inflate configuration, wherein at least one of the one or more sleeve ports is in fluid communication with the housing port, and a retracted configuration, wherein the at least one of the one or more sleeve ports is not in fluid communication with the housing port.

Statement 2: An inflatable packer is disclosed according to Statement 1, wherein the one or more ports formed in the one or more packers are one or more inflation ports and one or more deflation ports, actuation of the actuator moving the shifting sleeve to align with the one or more inflation ports during inflation of the one or more packers and actuation of the actuator moving the shifting sleeve to align with the one or more deflation ports during deflation of the one or more packers.

Statement 3: An inflatable packer is disclosed according to any of the preceding Statements, wherein the housing has a treatment port formed therein, and the electric actuator is operable to shift the shifting sleeve to a treatment configuration, wherein a portion of the one or more sleeve ports is in fluid communication with the treatment port.

Statement 4: An inflatable packer is disclosed according to any of the preceding Statements, wherein the electric actuator is an electric motor.

Statement 5: An inflatable packer is disclosed according to any of the preceding Statements, wherein the actuator is a combination of electric motor and shaft drive system.

Statement 6: An inflatable packer is disclosed according to Statement 5, wherein the electric actuator is utilized for one or more additional downhole tools.

Statement 7: An inflatable packer is disclosed according to any of the preceding Statements, wherein the tubular conveyance is a coiled tubing string.

Statement 8: A downhole electrically actuated inflatable packer system is disclosed as comprising: a conveyance disposed within a wellbore; a housing coupled with the conveyance, the housing having a housing port formed therein; a shifting sleeve disposed within the housing, the shifting sleeve having one or more sleeve ports formed therein; an inflatable packer coupled with the housing, and in fluid communication with the housing port; and an electric actuator operable to shift the shifting sleeve between an inflate configuration, wherein at least one of the one or more sleeve ports is in fluid communication with the housing port, and a retracted configuration, wherein the at least one of the one or more sleeve ports is not in fluid communication with the housing port.

Statement 9: A system is disclosed according to Statement 8, wherein the shifting sleeve has an equalization port formed therein, the housing has a housing equalization port formed therein, and the electric actuator is operable to shift the shifting sleeve to a circulation/equalization configuration, wherein the equalization port is in fluid communication with the housing equalization port.

Statement 10: A system is disclosed according to any of preceding Statements 8-9, wherein the housing has a treatment port formed therein, and the electric actuator is operable to shift the shifting sleeve to a treatment configuration, wherein a portion of the one or more sleeve ports is in fluid communication with the treatment port.

Statement 11: A system is disclosed according to any of preceding Statements 8-11, wherein the electric actuator is an electric motor.

Statement 12: A system is disclosed according to Statement 11, wherein the electric actuator is utilized for one or more additional downhole tools also coupled with the conveyance.

Statement 13: A system is disclosed according to any of preceding Statements 8-12, wherein the housing is coupled to a coiled tubing string.

Statement 14: A method of using an actuatable inflatable packer is disclosed, the method comprising: running an electrically actuated inflatable packer into a wellbore on a conveyance so as to position the electrically actuated inflatable packer at a predetermined downhole location, wherein the electrically actuated inflatable packer is in a deflated position and comprises a housing having a housing port formed therein, the electrically actuated inflatable packer coupled with a shifting sleeve disposed within the housing and having one or more sleeve ports formed therein; and shifting the shifting sleeve to an inflate configuration, wherein at least one of the one or more sleeve ports is in fluid communication with the housing port to allow passage of fluid into the electrically actuated inflatable packer.

Statement 15: A method is disclosed according to Statement 14, wherein the one or more sleeve ports are one or more inflation ports and one or more deflation ports.

Statement 16: A method is disclosed according to any of preceding Statements 14-15, further comprising shifting the shifting sleeve into a treatment configuration, wherein a portion of the one or more sleeve ports is in fluid communication with a treatment port of the housing.

Statement 17: A method is disclosed according to Statement 16, wherein the housing is coupled to a coiled tubing string.

Statement 18: A method is disclosed according to any of preceding Statements 14-17, wherein an electric actuator shifts the shifting sleeve, the electric actuator including an electric motor.

Statement 19: A method is disclosed according to any of preceding Statements 14-18, wherein an electric actuator shifts the shifting sleeve, the electric actuator comprising a combination of electric and rod drive system.

Statement 20: A method is disclosed according to Statement claim 19, further comprising actuating an additional downhole tool.

Statement 21: A method is disclosed according to any of preceding Statements 14-20, wherein shifting of the shifting sleeve does not require movement of a conveyance.

Statement 22: A system is disclosed according to any of preceding Statements 8-14, wherein shifting of the shifting sleeve does not require movement of the conveyance.

Statement 23: An electrically actuated inflatable packer is disclosed according to any of preceding Statements, 1-7, wherein shifting of the shifting sleeve does not require movement of a conveyance.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. An electrically actuated inflatable packer assembly comprising:

a housing coupled with a tubular conveyance, the housing having a housing port formed therein;

a shifting sleeve disposed within the housing, the shifting sleeve having one or more sleeve ports formed therein;

an inflatable packer coupled with the housing, and in fluid communication with the housing port; and an electric actuator operable to shift the shifting sleeve between an inflate configuration, wherein at least one of the one or more sleeve ports is in fluid communication with the housing port, and a retracted configuration, wherein the at least one of the one or more sleeve ports is not in fluid communication with the housing port.

2. The electrically actuated inflatable packer assembly of claim 1, wherein the shifting sleeve has an equalization port formed therein, the housing has a housing equalization port formed therein, and the actuator is operable to shift the shifting sleeve to a circulation/equalization configuration, wherein the equalization port is in fluid communication with the housing equalization port.

3. The electrically actuated inflatable packer assembly of claim 1, wherein the housing has a treatment port formed therein, and the electric actuator is operable to shift the shifting sleeve to a treatment configuration, wherein a portion of the one or more sleeve ports is in fluid communication with the treatment port.

4. The electrically actuated inflatable packer assembly of claim 1, wherein the electric actuator is an electric motor.

5. The electrically actuated inflatable packer assembly of claim 1, wherein the actuator is a combination of electric motor and shaft drive system.

6. The electrically actuated inflatable packer assembly of claim 5, wherein the electric actuator is utilized for one or more additional downhole tools.

7. The electrically actuated inflatable packer assembly of claim 1, wherein the tubular conveyance is a coiled tubing string.

8. A downhole electrically actuated inflatable packer system comprising:

a conveyance disposed within a wellbore;

a housing coupled with the conveyance, the housing having a housing port formed therein;

a shifting sleeve disposed within the housing, the shifting sleeve having one or more sleeve ports formed therein;

an inflatable packer coupled with the housing, and in fluid communication with the housing port; and an electric actuator operable to shift the shifting sleeve between an inflate configuration, wherein at least one of the one or more sleeve ports is in fluid communication with the housing port, and a retracted configuration, wherein the at least one of the one or more sleeve ports is not in fluid communication with the housing port.

9. The system of claim 8, wherein the shifting sleeve has an equalization port formed therein, the housing has a housing equalization port formed therein, and the electric actuator is operable to shift the shifting sleeve to a circulation/equalization configuration, wherein the equalization port is in fluid communication with the housing equalization port.

10. The system of claim 8, wherein the housing has a treatment port formed therein, and the electric actuator is operable to shift the shifting sleeve to a treatment configuration, wherein a portion of the one or more sleeve ports is in fluid communication with the treatment port.

11. The system of claim 8, wherein the electric actuator is an electric motor.

12. The system of claim 11, wherein the electric actuator is utilized for one or more additional downhole tools also coupled with the conveyance.

13. The system of claim 8, wherein the housing is coupled to a coiled tubing string.

14. A method of using an actuatable inflatable packer, the method comprising:

running an electrically actuated inflatable packer into a wellbore on a conveyance so as to position the electrically actuated inflatable packer at a predetermined downhole location, wherein the electrically actuated inflatable packer is in a deflated position and comprises a housing having a housing port formed therein, the electrically actuated inflatable packer coupled with a shifting sleeve disposed within the housing and having one or more sleeve ports formed therein; and shifting the shifting sleeve to an inflate configuration, wherein at least one of the one or more sleeve ports is in fluid communication with the housing port to allow passage of fluid into the electrically actuated inflatable packer.

15. The method of claim 14, wherein the one or more sleeve ports are one or more inflation ports and one or more deflation ports.

16. The method of claim 14, further comprising shifting the shifting sleeve into a treatment configuration, wherein a portion of the one or more sleeve ports is in fluid communication with a treatment port of the housing.

17. The method of claim 14, wherein the housing is coupled to a coiled tubing string.

18. The method of claim 14, wherein an electric actuator shifts the shifting sleeve, the electric actuator including an electric motor.

19. The method of claim 14, wherein an electric actuator shifts the shifting sleeve, the electric actuator comprising a combination of electric and rod drive system.

20. The method of claim 19, further comprising actuating an additional downhole tool.

* * * * *